US009739530B2

(12) United States Patent
Nimmo, Sr.

(10) Patent No.: US 9,739,530 B2
(45) Date of Patent: Aug. 22, 2017

(54) MICROWAVE DRYING OF SEED COTTON AND OTHER CROPS

(71) Applicants: Jimmy Ray Stover, Corpus Christi, TX (US); Caroline Marie Nimmo, Lemoore, CA (US)

(72) Inventor: Ronnie Joe Nimmo, Sr., Lemoore, CA (US)

(73) Assignees: Jimmy Ray Stover, Corpus Christi, TX (US); Caroline Marie Nimmo, Lemoore, CA (US)

( * ) Notice: Subject to any disclaimer, the term of this patent is extended or adjusted under 35 U.S.C. 154(b) by 15 days.

(21) Appl. No.: 14/544,867

(22) Filed: Feb. 27, 2015

(65) Prior Publication Data

US 2015/0247266 A1 Sep. 3, 2015

Related U.S. Application Data

(60) Provisional application No. 61/996,626, filed on May 12, 2014, provisional application No. 61/966,737, filed on Feb. 28, 2014.

(51) Int. Cl.
*D01B 1/04* (2006.01)
*F26B 3/347* (2006.01)

(52) U.S. Cl.
CPC ..... *F26B 3/347* (2013.01); *D01B 1/04* (2013.01)

(58) Field of Classification Search
CPC ..... D01G 23/04; F26B 3/347; D01B 1/04; D01B 1/06; D01B 1/08
See application file for complete search history.

(56) References Cited

U.S. PATENT DOCUMENTS

| | | | | |
|---|---|---|---|---|
| 3,169,664 | A * | 2/1965 | Meinicke | D01G 23/02 19/105 |
| 3,940,885 | A | 3/1976 | Gray | |
| 4,038,758 | A | 8/1977 | Miller | |
| 4,509,273 | A | 4/1985 | Roisen | |
| 4,640,020 | A | 2/1987 | Wear | |
| 4,649,055 | A | 3/1987 | Kohlwey | |
| 4,657,444 | A * | 4/1987 | Pinto | D01G 23/04 19/105 |
| 4,776,066 | A * | 10/1988 | Leifeld | D01G 23/04 19/105 |
| 4,779,311 | A * | 10/1988 | Leifeld | D01G 23/04 19/105 |
| 4,896,400 | A | 1/1990 | Polli | |
| 4,912,914 | A | 4/1990 | Wingard | |
| 4,999,926 | A | 3/1991 | Knabenhans | |
| 5,008,978 | A | 4/1991 | Waeber | |

(Continued)

*Primary Examiner* — Shaun R Hurley
(74) *Attorney, Agent, or Firm* — G. Turner Moller

(57) ABSTRACT

A microwave dryer includes a vertical chamber having sensors determining the level of agricultural products in the chamber and a series of wave generators delivering wave energy into the chamber. If the level sensors detect an air/product interface in the chamber, wave generators above the interface are deactivated. Temperature sensors in the chamber are used to limit power input through the wave generators and to determine the presence of water rich areas in the chamber. In the event water rich areas are detected, additional power is delivered to wave generators downstream of the water rich areas. The wave generators are mounted on a wall spaced from the chamber through which product flows.

19 Claims, 4 Drawing Sheets

(56) References Cited

U.S. PATENT DOCUMENTS

| | | | | |
|---|---|---|---|---|
| 5,048,156 | A | 9/1991 | Waeber | |
| 5,105,563 | A | 4/1992 | Fingerson | |
| 5,153,968 | A | 10/1992 | Sterin | |
| 5,156,570 | A | 10/1992 | Justice, III | |
| 6,536,133 | B1 | 3/2003 | Snaper | |
| 6,807,750 | B1 * | 10/2004 | Lewis | F26B 17/101 19/66 CC |
| 8,046,877 | B2 | 11/2011 | Nimmo | |
| 8,356,389 | B2 | 1/2013 | Nimmo | |
| 9,303,919 | B2 * | 4/2016 | Hultgren | F26B 3/28 |

* cited by examiner

MICROWAVE DRYING OF SEED COTTON AND OTHER CROPS

This application is partially based on U.S. Provisional Patent Application Ser. No. 61/966,737 filed Feb. 28, 2014 and U.S. Provisional Patent Application Ser. No. 61/996,626 filed May 12, 2014, priority of which is claimed.

This invention relates to the drying of seed cotton and other crops.

BACKGROUND OF THE INVENTION

Cotton, wheat, corn, sorghum, soybeans, and hay or silage are typical crops that are widely grown. Harvesting these crops cannot be started in the morning until the sun has warmed the plants sufficiently to drive off dew or other moisture. Harvesting can continue until dew falls in late evening, typically long after the sun has gone down. Thus, there is a long period—often about 12 hours a day—when most crops cannot be harvested because the crop is too wet. The exact moisture conditions differ somewhat for different crops but the overall problem is the same, i.e. if the crop is too wet, harvesting has to wait because the wet crop will, rot. Sorghum, corn and other grains are a particular problem because, when harvested too wet, they cannot be fed even to livestock because of the production of certain aflatoxins.

When cotton is picked or stripped in the field, a wide variety of things accumulate in a cotton module that is transported to a gin for ginning. Picked or stripped seed cotton produces a collection of cotton lint, motes, cotton seed and gin trash, which is the industry term for dirt, leaves, stems, weeds and weed seeds. Currently, seed cotton is dumped from a picker or stripper into a module builder on the edge of a field where a large rectangular module is created by tamping the seed cotton in a large metal container. A new generation of cotton pickers produces a module which is discharged on the field, eliminating the need for a separate module builder. One of the new generation of cotton pickers produces a plastic wrapped round module.

Picking of cotton from the field does not normally start until the morning sun warms the plants sufficiently to drive off any dew or other moisture. A moisture sensor is typically used to determine the moisture content of the plant so picking can be delayed until the moisture content in the seed cotton and debris falls below some predetermined value, typically around 12%. The reason is that, at higher moisture levels, there is a risk of plant debris rotting or excessive moisture causing microbial changes in cotton fibers resulting in staining which cannot be removed before the cotton is ginned because there is often a delay of up to several months from the time cotton is picked until it is ginned. When considerable rotting or staining occurs, the cotton fibers are degraded thereby reducing the grade of the ginned cotton and thus the price obtained for it.

The cotton modules are delivered to a cotton gin where the module is stored until the gin is ready for the particular module. The module is delivered onto the conveyor of a module feeder where it is disintegrated so cotton clumps pass into the gin where the lint is separated from cotton seeds and gin trash. One of the operations in a conventional cotton gin is to heat the unprocessed cotton enough to further reduce the moisture content. This is desirable because it is much easier to separate cotton and seed from leaves, stems and the like at low moisture levels as opposed to higher moisture levels. For example, conventional gin stands operate efficiently at moisture levels in the 4-6% range while roller gin stands operate best at much lower moisture levels.

In the past, almost all gins have used a natural gas, propane or LPG fired heater to heat the seed cotton and evaporate some or most of the water from the stream passing through the dryer.

It is known in the prior art to use microwaves to heat ginned cotton to counteract the effects of honeydew on cotton as shown in U.S. Pat. Nos. 4,896,400; 4,999,926; 5,008,978 and 5,048,156. It is known in the prior art to incorporate dryers in harvesters of hay, U.S. Pat. Nos. 4,912,914 and 5,105,563, and grains, U.S. Pat. Nos. 4,038,758; 4,509,273; 5,156,570; and 6,536,133. Of more general interest are the disclosures in U.S. Pat. Nos. 3,940,885; 4,640,020; 4,649,055 and 5,153,968. At least one attempt has been made to dry seed cotton in a cotton gin environment with microwaves but was unsuccessful because it popped the cotton seeds and the attempt was abandoned. Conventional domestic microwave ovens and conventional radio frequency ovens have been used to dry seed cotton in a laboratory in a research project to estimate cotton yields early in the season at a time before the bolls open.

SUMMARY OF THE INVENTION

This application discloses improvements over the disclosures in U.S. Pat. Nos. 8,046,877 and 8,356,389 which are incorporated herein by reference.

In one aspect, a method and apparatus used in a cotton gin uses one or more wave energy sources and controls the production of, power from the sources by using inputs from upstream and/or within a heating chamber. In some embodiments, an upstream sensor may determine the moisture content of seed cotton and one or more sensors in the heating chamber may be used in conjunction with the moisture sensor to control power production by the wave generators.

In some embodiments, an array of wave energy generators is used to produce a dispersed energy field having an energy density in the range of 0.2-6 kilowatts per pound of seed cotton. It has been learned that energy densities less than two tenths kilowatt per pound of seed cotton are not very effective in reducing moisture in seed cotton. Concentrated wave energy or energy densities greater than six kilowatts per pound of seed cotton tend to heat the seed cotton so much that the cotton seeds pop like popcorn and popped cotton seeds are not salable. In addition, modern cotton gins are not equipped to separate lint from popped cotton seeds.

When using an array of wave energy sources, it may be advantageous to produce energy from less than all of the sources in order to better control heating in the heating chamber. For example, in situations where a relatively dry batch of seed cotton enters the heating chamber, reducing or eliminating the output of some of the energy sources may be advantageous in reducing power costs and minimizing the risk of fire. An important advantage may accrue by pulsing the wave energy generators and thereby reducing their output as opposed to continuously operating the wave energy generators at a reduced output.

In a cotton gin environment, some of the dryer embodiments may be housed in conduits between conventional equipment in the gin or, preferably, in a feed controller near the upstream end of the gin. In some embodiments, the conduit or feed controller may be of metal having flat sides, such as square or rectangular conduit.

Another important advantage of the seed cotton dryer, in a cotton gin environment, is a substantial reduction in pollutants escaping to the atmosphere. This is particularly advantageous in areas such as California where increasingly strict regulations restrict the use of natural gas fired dryers and/or increase their cost of operation.

There are other crops or materials that can advantageously be heated with wave energy, such as walnuts, almonds, pistachios, other nuts, seeds such as cotton seeds and grains such as corn, sorghum, wheat and the like as well as corn stover, saw grass and other fibrous materials in preparation for subsequent treatment, such as breaking of cellulose bonds in preparation for conversion of cellulose to sugars.

It is an object of this invention to provide an improved method and apparatus for drying seed cotton.

Another object of this invention is to provide an improved method and apparatus for drying seed cotton by better controlling the production of wave energy power in a heating chamber.

A further object of this invention is to provide a suitable technique for controlling the application of wave energy power in a chamber through which the material to be heated moves.

These and other objects and advantages of this invention will become more fully apparent as this description proceeds.

DETAILED DESCRIPTION OF THE INVENTION

Figure 1:
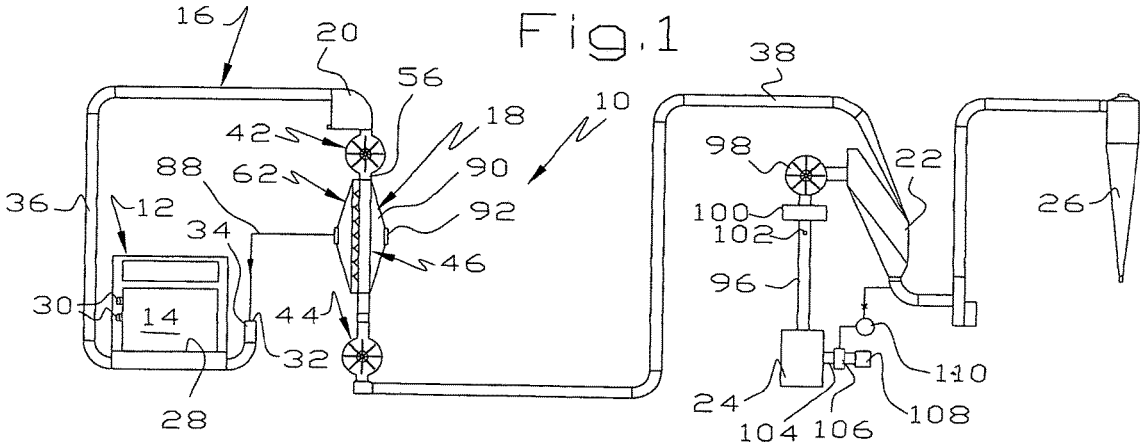
FIG. 1 is a schematic view of part of a cotton gin.
Figure 3:
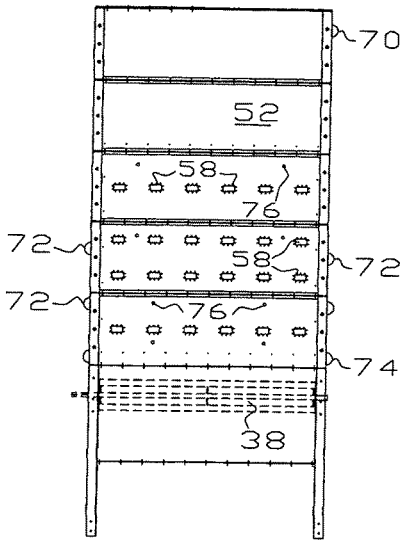
FIG. 3 is a rear view of a feed controller into which a dryer is incorporated.
Figure 2:
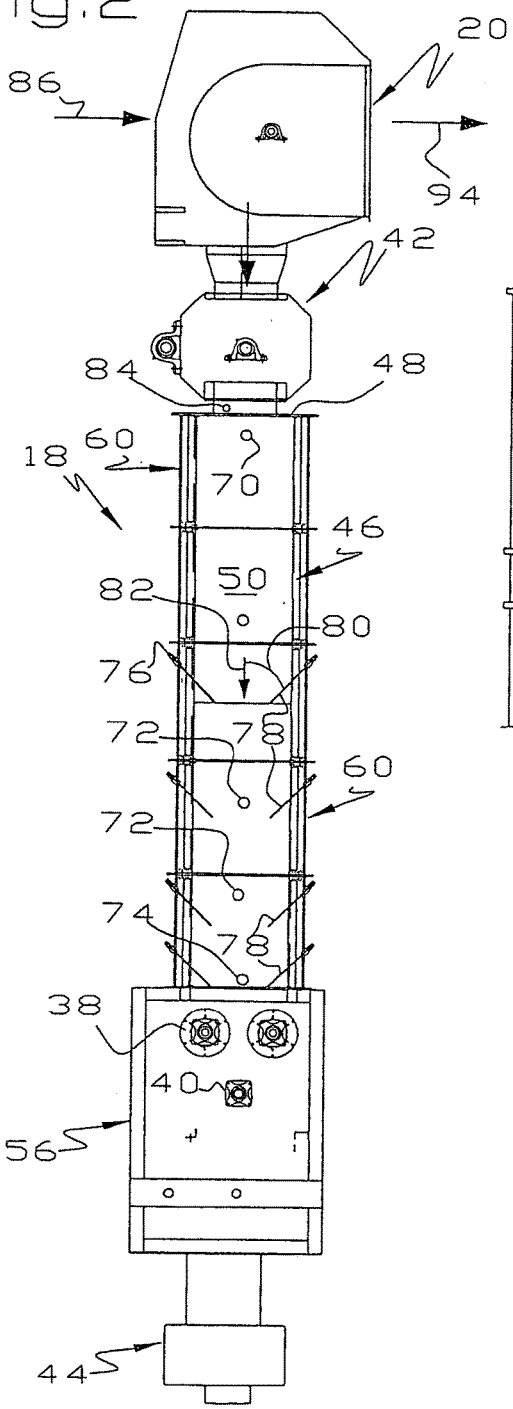
FIG. 2 is an enlarged view of the heating chamber or feed controller of FIG. 1, partly in section, illustrating an air lock and several temperature probes.

Referring to FIGS. 1-3, there is illustrated part of a cotton gin 10 which may comprise, as major components, a module feeder 12 for disintegrating a cotton module 14, a transport system 16 for delivering cotton clumps from the module feeder 12 through the various components of the gin 10, a feed controller 18, a series of separators or cleaners 20, 22 for separating cotton seed and lint from plant debris, one or more gin stands 24 for separating cotton seed from lint and one or more separators or cyclones 26 for separating gin trash from conveying air.

The module feeder 12 may be of any conventional type and typically includes an inlet conveyor 28 on which a rectangular or round module 14 is moved toward a plurality of disperser drums 30 which disintegrate the module 14. Cotton clumps from the module 14 are moved by the transport system 16 through the various components of the gin 10.

In some embodiments, the transport system 16 is pneumatic in the sense of having an air inlet 32 and a fan 34 pushing air through a series of conduits 36 provided by the transport system 16 thereby moving the cotton clumps toward or through the various components of the gin 10.

Most, but not all, conventional cotton gins include a separator/cleaner 20 near the module feeder 12 for removing air and trash from the stream of material exiting the module feeder so seed cotton travels by gravity through the feed controller 18. Many gins include a feed controller 18 near the inlet end of the transport system 16 having the capability of accumulating seed cotton and then withdrawing the accumulated seed cotton for the purpose of keeping the gin stands 24 full. To this end, manipulating a series of feed rollers 38 near the discharge end of the feed controller 18 increases or decreases the flow of seed cotton from the controller 18 typically in response to a feedback loop from the gin stands 24. Conventionally, a wad buster 40 may be provided downstream of the feed rollers 38 for disintegrating any cotton clumps. Air locks 42, 44 are conventionally provided in gins employing air conveyed cotton near the inlet and outlet ends of the feed controller conduit 46 to prevent loss of conveying air while allowing cotton to continue moving through the gin 10. The air locks 42, 44 may be of any suitable type to eliminate any conveying air in the feed controller 18 so flow through the controller 18 is by gravity.

Some air locks work by sealing an elongate conveyance area, which is round in cross-section, with a rotary array of rubber wipers that allow seed cotton and trash to pass through a round chamber while sealing off the conveyance area and thereby preventing air loss. It is possible that standard air locks might leak microwave or radio frequency energy so, in some embodiments, the interior of the arcuate housing is designed to prevent wave energy leakage as discussed in patents As shown best by a comparison of FIGS. 2-4, in some embodiments the feed controller conduit 46 is of rectangular cross-section having an inlet 48 spanning the width of the air lock 42, a pair of flat parallel side walls 50, a pair of flat parallel end walls 52, 54 and an outlet 56 which can be of any suitable shape, including a conventional funnel, in which the feed rollers 38 and wad buster 40 are located. The optimal shape of the conduit 46 may vary and much depends on the capacity of the gin or the speed of cotton moving through the conduit 46. The depth of penetration of the waves is a function of the frequency of the wave generator and it is desirable for the wave energy to penetrate the seed cotton moving in the conduit 46. In many embodiments, feed controller conduits 46 are much wider than they are deep, as shown best by a comparison of FIGS. 2 and 3. In many embodiments, the side and end walls 50, 52, 54 need not be square or rectangular but they are preferably some type polygon because the angle between flat walls scatter wave energy better than round or smoothly curved walls. Although the conduit 46 may be of a single device, it may be preferred to make the conduit 46 from a plurality of separate sections 60 to provide better access to the interior of the conduit 46 for purposes more fully apparent hereinafter. The sections 60 may be bolted together or otherwise joined in a manner allowing them to be unconnected thereby providing access to the interior of the flow conduit 46.

Conventionally, the unprocessed seed cotton and plant debris is dried by burning natural gas and delivering the hot combustion products to the inlet 34 of the transport system 16 so the seed cotton is heated to evaporate some or most of the water absorbed on the seed cotton and plant parts. Typically, there is considerable heat loss because of conduction, convection and radiation from the conduits transporting the combustion products plus heat loss from air leaks which can reach as high as 30%.

In some embodiments, seed cotton and trash are heated by wave energy in the electromagnetic spectrum. In some embodiments, the wave energy generators 58 can be placed in the conduits 38 of the transport system 16 or in a belt dryer (not shown). Preferably, the wave generators 58 are placed upstream from a cleaner or stick machine because dried seed cotton separates much more easily from trash than moist seed cotton and seed cotton dried by the application of wave energy separates much better than seed cotton dried by natural gas fired heaters. One of the unusual features of cotton dried by wave energy is the ease of separating trash from seed cotton. Preferably, the wave energy generators 58 may be located in or are a part of the feed controller 18 or, in gins not having a feed controller, near the module feeder 12 so the first cleaner works better.

In FIGS. 1-5, the dryer 62 is illustrated as being part of the feed controller 18. It may be preferred that the conduit to which wave energy generators 58 are attached to flat connected walls. Round or smoothly curved conduits, although operative, do not scatter wave energy as effectively as flat walled conduits. Rather than attach the generators 58 to the side walls of the conduit 46, it may be preferred to attach the generators 58 and a wave guide 64 to a wall 66 outside and spaced from the conduit 46 thereby providing an air gap 68 between the wall 66 and the conduit 46 as shown best in FIG. 5. This produces a more even distribution of wave energy inside the conduit 46 because the waves' delivered by the generators 58 though the wave guides 64 expand in, traveling toward and through the conduit 46. The dimension of the air gap 68 is subject to considerable variation. The gap 68 should be large enough to allow some expansion of the waves emitting from the generators 58 but not be so large as to make the feed controller 18 unwieldy. The gap may be in the range of 1-12" and may preferably be on the order of 3".

The wall 66 and the conduit 46 may preferably be made of a dielectric or insulating material such as suitable polymers such as the polymer known in the trade as UHMW to avoid arcing in the event some metal component touches or comes close to the wall 66 or conduit 46 while the wave energy generators 58 are energized. There may be no need for the ends of the conduit 46 to have a false wall comparable to the wall 66 so there may not need to be a gap on the ends of the conduit 46.

In some embodiments a multiplicity of relatively small capacity wave energy generators 58 are placed in a grid or array on one of the large flat side walls 52, 54 of the feed controller conduit 46. As will become more fully apparent hereinafter, the wave energy source is preferably dispersed to provide a relatively large area that is heated thereby preventing overheating of cotton seed to the extent that the seed pops.

In some embodiments, the wave energy generator are radio frequency generators producing frequencies, for example, preferably in the range of 13.56-40.68 mHz. In some embodiments, the wave energy generators are microwave magnetrons producing frequencies, preferably in the range of 915-2450 mHz or wave lengths in the range of 24-4.5 inches which is a very small part of the electromagnetic spectrum of 300 mHz to 3 gHz. It will be apparent that there is a very wide range of frequencies that are operative to heat water on the seed cotton passing through the dryer.

The power output of each individual wave energy generator 58 in a given heater can vary considerably, depending on a variety of factors: (1) the measured moisture content of seed cotton upstream of the heater, (2) temperature measurements inside the heater and (3) the volume of seed cotton passing through the heater. In some situations, it may be advantageous to power less than all of the wave energy generators. The power input to the heater may be controlled by changing the output of each individual wave energy generator by pulsing the generators, i.e. turning them on and off, rather than reducing the power more-or-less uniformly to an array of generators. This flexibility allows the control of temperature in the heater and may provide an important advantage by reducing electricity costs when measurements suggest that liquid moisture on lint in the heater is at or below a desired value.

Figure 4:
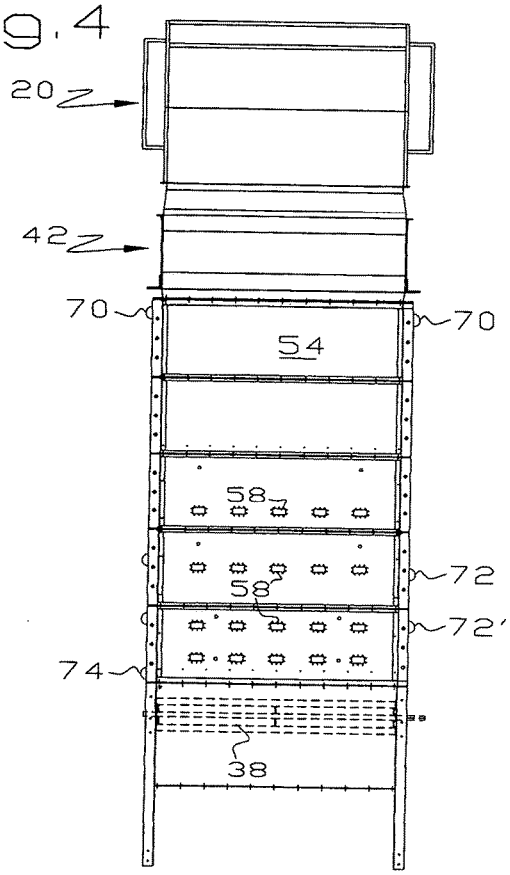
FIG. 4 is a front view of an opposite side of the feed controller of FIG. 3.

To these ends, in some embodiments, the array may be a series of lines of generators where each line is offset by one half the spacing between generators or may be aligned as shown in FIG. 3. In some embodiments, as shown in FIG. 4, the generators 58 on the back of the dryer 62 are offset or staggered relative to the front shown in FIG. 3. In embodiments where the generators 58 are of the same capacity, the pattern of the generators 58 tends to be regular, i.e. spaced equidistantly from each other, although such is for convenience and may be subject to change. In embodiments where the generators are of different capacity, the pattern may be substantially nonuniform or random. One actor increasing the efficiency of the dryer is that the heat source is directly on the conduit 46 transporting cotton clumps in contrast to the conventional situation where the natural gas fired dryer is necessarily many feet away from the transport conduit. This inherently reduces heat losses from conduction, convection, radiation and air leaks.

There are upper and lower limits for the effective use of wave energy heating of seed cotton. There are a number of ways of expressing these limits. One problem is that no reasonably accurate measurements are made in a gin environment of the total weight of material being processed. Weight or volume measurements are made of cotton lint, seed cotton and cotton seeds. Roughly 1500 pounds of seed cotton produces 500 pounds of lint, 700-800 pounds of seed and 200 pounds of trash, condensed water and motes. Given the quantity of cotton lint being ginned, experienced people can make a reasonable estimate of the range of cotton seeds and gin trash being handled. Thus, it is estimated that the quantity of cotton seeds and gin trash in normal picked cotton is about 200% by weight of the amount of cotton lint. Stripped seed cotton, as contrasted to picked cotton, contains considerably more trash, e.g. 20-30% more than in picked seed cotton. What is known in a gin environment is the weight and/or volume of cotton lint being produced by the gin and is normally expressed in bales/hour. Currently, a bale is nominally 500 pounds of cotton lint.

A convenient expression for power output is the wattage of the wave energy generators. As is apparent from the particular pattern of FIG. 4, the generators produce a dispersed, as contrasted to a concentrated, energy that is reasonably averaged, both by the number and pattern of the generators 58 and because of scattering of energy waves inside the conduit 46. In effect, there is an energy distribution zone where the energy delivered by the generators 58 is more-or-less constant per unit area.

In some embodiments, the wave energy generators 58 produce a dispersed energy field having an energy density in the range of 0.2-6 kilowatts per pound of seed cotton. It has been learned that energy densities less than two tenths of a kilowatt per pound of seed cotton is not very effective in reducing moisture in seed cotton. Energy densities greater than six kilowatts per pound of seed cotton tends to heat the seed cotton so much that the cotton seeds pop like popcorn.

Another way of expressing the energy density of the wave energy source is in kilowatts per unit area of an energy distributing zone where the outer boundaries are about one half the distance between generators 58. It will be realized that the residence time of seed cotton in the conduit 46 has a substantial bearing on the total amount of energy delivered to the seed cotton. Residence time accordingly has a place in controlling or limiting the amount of wave energy applied to the seed cotton. It has been found with reasonable residence times that energy densities of less than about 0.3 kilowatts per square foot are not very effective to reduce moisture content in seed cotton while energy densities of greater than ten kilowatts per square foot is so great that overheating of the seed cotton is likely. In a prototype, having the generator array of FIG. 4, the energy distributing zone had the capacity to deliver 48,000 watts over an area of twenty one square feet or an average of 2.286 kilowatts per square foot. This prototype was tested in a gin having a throughput of about 5000 pounds or ten bales of lint per hour which is about 15,000 pounds of seed cotton per hour, meaning that the energy density of the prototype was about 230 watts per square foot per bale of lint per hour or about 0.0153 watts per square foot per pound of seed cotton per hour. Short test runs reduced the moisture content of seed cotton significantly by amounts that correlated with the energy input from the generators 58.

Another factor affecting the desired amount of energy input is the depth of the conduit 46 in a direction perpendicular to the side walls 52, 54 or parallel to the end walls 50. By placing wave energy generators 58 on opposite walls, thicker conduits 46 may be more feasible and have more capacity. On the other hand, a smaller capacity heater/dryer 64 may have wave generators 58 on only one side of the conduit 46.

An important advantage of the dryer 62 is provided by one or more level sensors including an upper sensor 70, one or more intermediate sensors 72 and a lower sensor 74. Although the level sensors 70, 72, 74 may be of any suitable type, a photocell may be preferred. The function of the sensors 70, 72, 74 is to determine whether seed cotton exists at the elevation of the particular sensor. For example, when sensor 70 does not detect light from its source, this determines that the conduit 46 is substantially full of seed cotton. Operation of the remaining sensors is somewhat different. If a particular sensor 72 detects no seed cotton inside the conduit 46 but the next subjacent sensor 72' detects seed cotton inside the conduit 46, only those generators 58 at or below the sensor 72' are preferably actuated. This is one technique to reduce the amount of electricity delivered to the generators 58 and still provide adequate vaporization of moisture on the seed cotton. Another advantage is that having cotton on top of the generators 58 tends to prevent wave energy from migrating upwardly through the conduit 46 and escaping into the surrounding gin 10. Having seed cotton in the bottom of the conduit 46 also tends to prevent wave energy from escaping into the gin 10 through the bottom of the conduit 46. Thus, seed cotton in the conduit 46 acts as a microwave choke minimizing or preventing loss of wave energy through the top and bottom of the conduit 46.

Another advantage of the device of FIGS. 2-5 is provided by a series of temperature sensors 76 arranged along the direction of travel of cotton in the conduit 46. Each temperature sensors 76 may comprise a probe 78 extending downwardly into the conduit 46 at an acute angle 80 with the direction of travel 82 inside the conduit 46. This orientation of the temperature probe 78 reduces or minimizes the tendency of cotton lint, plant parts and seed to hang up on the probe 78. The temperature sensors 76 may be arranged in any suitable manner along the direction of travel of seed cotton in the conduit 46. There may be one or more sensors 76 at any given level, two being illustrated in FIGS. 3 and 4.

Readings from the sensors 76 are incorporated into software controlling operation of the generators 58 as more fully apparent hereinafter. In a simplified approach, any temperature reading above a predetermined value may be used to reduce the energy delivered by the generators 58 to the conduit 46. For example, it may be determined that a particular temperature, e.g. 275° F. may be on the verge of a fire hazard, so sensing such a temperature by one of the sensors 76 may be used to curtail power delivered to the generators 58. To avoid a simple sensor malfunction from reducing power, sensing of a fire hazard temperature by more than one of the sensors 76 may be employed. Because one or more of the generators 58 may be turned on or off, it will be evident that heating in the conduit 46 is not necessarily uniform.

In a more sophisticated approach, the control unit may use readings from the temperature sensors 76 to determine a temperature profile in the conduit 46. The temperature profile may show constant temperature in the conduit 46, increasing temperature as the outlet is approached or decreasing temperature as the outlet is approached. After creating a temperature profile, the control unit may then determine whether there is an area of high temperature in the conduit 46, over the temperature profile, which is indicative of a substantial quantity of liquid water and, in response to the determination of an area of high temperature, deliver increased electrical energy to the wave generators 58 downstream of the area of high temperature. Delivering increased electrical energy may be accomplished by raising the pulse rate of energy application to the wave generators 58.

Wave energy heating of seed cotton has an important advantage over conventional natural gas, propane or LPG heating. In conventional heating, a fuel is burned in air to produce a hot gaseous mixture of combustion products, nitrogen and oxygen left over from the combustion process. This hot gaseous mixture is delivered to the pneumatic conveyor system at the module feeder to convey seed cotton toward a separator and feed controller and vaporizes much of the liquid water on the seed cotton. This mixture is relatively combustible because there is considerable fuel and some oxygen left over where the cotton lint, seeds and plant parts are widely distributed in the conveying gas. In wave energy heating in the conduit 46, the seed cotton is relatively packed inside the conduit 46 so there is relatively little air present so this material is relatively incombustible. As an analogy, it is easy to ignite a loose stream of cotton in air but very difficult to ignite packed cotton, such as a cotton bale coming from a compress. At any temperature, wave energy heating appears to less of a fire hazard than conveying seed cotton with hot combustion products. Similarly, wave energy heating can operate safely at a higher temperature than heating with combustion products.

Although it is feasible that each individual generator 58 can be energized independently of all other generators 58, it may be preferred to simultaneously energize all of the generators 58 at a particular level. In other words, in FIG. 4, all of the generators 58 in the lowermost set of generators may preferably be energized at the same time.

A humidity or moisture sensor 84 at the inlet 48 or any location between the module feeder 12 and the feed controller 18 may be used to control the amount of energy delivered to the generators 58. For example, if it is desired that cotton lint leaving the dryer/heater 62 have 7% or less moisture and the sensor 84 detects that incoming moisture is only 9%, only minimal power may be delivered to the generators 58.

Rather than deliver continuous power at variable levels to the generators 58, it may be preferred to pulse power to the generators 58 and thereby control their wave energy output rather than reduce the power input to a continuously powered generator. For example, in a simple experiment, continuously applying microwave energy to seed cotton caused the seeds to pop in a relatively short time. By turning the microwave generator on for a few seconds and then off for a few seconds, pulsing continued for a lengthy time before the seeds popped. The sum of the "on periods" far exceeded the time for continuous operation to pop the cotton seeds, meaning that pulsing the microwave generator satisfactorily delivered more energy to the seed cotton than continuous operation. Without being bound by any theory, it appears that the "off periods" allow the temperature of the seed to equalize or cool off enough so it doesn't pop upon arrival of the next pulse.

The rate of pulsation of the generators 58 is subject to wide variation. The length of the "on periods" should not be so long as to induce popping of cotton seed before the next "off period." The length of the "off periods" should be long enough to take advantage of the equalizing or cooling off the seeds to allow application of considerable amounts of energy but should not be so long as to substantially reduce the amount of energy delivered into the conduit 46. It will be noted that during the "off periods," heat generated in the seed cotton is still working to vaporize liquid water. In other words, even in the "off periods," liquid water is being vaporized off the seed cotton.

Operation of the dryer/heater 62 will now be explained. On start up, or start up after a stoppage of the gin 10, the feed rollers 38 are not driven unless the lowermost level sensor 74 indicates that seed cotton covers at least the lower end of the conduit 46 and until the temperature of the lowermost temperature sensor 76 is high enough to indicate that much of the water in the seed cotton at the bottom of the conduit 46 is vaporized.

In the event an intermediate level sensor 72 indicates there is no seed cotton at its level, any generators above the level of seed cotton are deenergized. When an intermediate sensor 72 indicates there is seed cotton at its level, generators at that level and below are energized.

Typically, moisture level in seed cotton is higher than desired, i.e. the gin stands 24 operate more efficiently at lower moisture levels than typically is present in seed cotton. Thus, in a typical situation, the conduit 46 is more-or-less full and all or most of the generators 58 are energized to vaporize water on the lint, cotton seed and plant parts. In the event the temperature sensors 76 detect a temperature in the conduit that is too high or that is a fire hazard, some or all of the generators 58 are deenergized or pulsing is slowed down. Typically, movement of seed cotton through the feed controller is slow but steady with liquid water being vaporized by wave energy from the generators 58.

Another important advantage of wave energy heating, particularly in the microwave range, is the tendency of water to absorb the energy of microwaves in preference to oils, sugars or fats which are also present in the seed, seed coating, leaves, stems and other plant parts which is believed to be a function of their dielectric properties. Accordingly, cotton seed doesn't heat up so much because water preferentially absorbs the wave energy. This is thought to be a substantial factor in the improved efficiency of wave energy drying of seed cotton because the weight of cotton seed is such a large fraction, typically about half, of the total weight through the dryer. Thus, microwaves preferentially heat water and thereby efficiently evaporate water from the seed cotton and trash passing through the dryer. This undoubtedly contributes to the efficiency of wave energy heating when contrasted to heating with conventional natural gas dryers along with the difference in surface moisture and hygroscopic traits of cotton fibers. In tests run through the prototype device, gin trash seemed to jump away from seed cotton. The correct explanation for the tendency of gin trash to separate from unginned cotton bolls is not known but it is believed to be related to a lower moisture content than is normally achieved with natural gas fired dryers and may be due to the ability of microwave energy to removed moisture embedded deeply within seed cotton and trash. Without being bound by any theory, it appeared almost as if the gin trash had an opposite static electric charge than the unginned cotton bolls although this explanation is difficult to believe. How this could be is not known. To improve separation of trash from seed cotton, it is desirable that the wave energy dryers be located upstream from the separators.

It will accordingly be seen that incorporating the dryer 62 into the feed controller 18 has the effect of using several components for different functions. For example, the conduit 46 acts as a surge capacity for the gin 10 in the normal manner of a feed controller and also acts as the drying zone and as an anchor for the generators 58. Similarly, the air locks 42, 44 prevent the loss of air from the transportation system 16 and also provides a safety feature by preventing the escape of microwave energy.

Another major advantage of using wave energy for drying seed cotton is the absence of combustion products. This is in contrast to conventional natural gas fired heaters which produce a great deal of carbon dioxide in a short ginning season.

A further advantage of using wave energy for drying seed cotton is an improvement in drying efficiency, i.e. producing more moisture reduction for less energy expenditure. This is a function of a variety of factors, such as the reduction in heat losses from the location where it is generated to the location where it is used, the tendency of wave energy to be preferentially absorbed by water so the effect of the applied energy is focused on what is desired to be removed and the ability to quickly adjust the amount of energy applied to seed cotton as temperature and moisture content of the crop varies.

Operation of the gin 10 should now be apparent. The module feeder 12 digests the cotton module 14 so conveying air from the fan 34 transports seed cotton from the module feeder 12 into the separator 20 in the direction of the arrow 86. The inlet of the fan 34 may be connected through a conduit 88 to a shroud 90 surrounding the wave energy generators 58 so air entering through an inlet 92 passes in heat exchange relation with the generators 58 to heat the air entering the pneumatic conveying system 16. In this manner, some heating of the seed cotton occurs before entering the feed controller 18.

Conveying air is removed by the separator 20 as shown by the arrow 94 so seed cotton falls by gravity into and through the feed controller 18. Sometimes, the seed cotton passes rapidly through the feed controller 18 and sometimes there is a longer residence time in the controller 18. In any event, the wave generators 58 deliver wave energy through the conduit 46 and heat the seed cotton. This causes some liquid water in the seed cotton to evaporate, the amount of which depends on the amount of energy applied to the seed cotton, the time that energy is applied, the geometry of the heating chamber and a number of other factors as will be apparent to those skilled in the art.

Heated seed cotton and high humidity air exit the conduit 46, pass through the air lock 44 and are picked up by conveying air and transported through the conduit 38. It is necessary to separate the high humidity air from the seed cotton so the evaporated moisture does not recondense on the seed cotton. This is analogous to the current situation where natural gas combustion products are used to heat seed cotton and the solutions are substantially the same. In other words, air is allowed to escape from the conduit 38 in a conventional manner at conventional locations, such as in the inclined cleaner 22, in other cleaners downstream from the heater 62, from conventional battery condensers and the like. In general, the sooner the water evaporated off the seed cotton is allowed to escape from the gin conduits and components, the better because there is less chance of the water recondensing on the seed cotton. In practice, allowing the water vapor to escape through the inclined cleaner 22 has proven satisfactory, at least partly because it takes only 4-5 seconds for cotton to reach the inclined cleaner 22 from the heater 62.

Connected to the inclined cleaner 22 is a cotton outlet 96 leading to the gin stands 24. An air lock 98 prevents air from travelling toward the gin stands 24 while transferring seed cotton to a conveyor/distributor 100 so cotton moves by gravity toward and through the gin stands 24, meaning than conveying air is removed upstream of the gin stands 24 and conveying air downstream of the gin stands 24 is used to separately convey lint, seeds and trash to their destinations. A moisture sensor 102 upstream of the gin stands 24 detects the moisture content of seed and lint and is used to control operation of the generators 58 as discussed hereinafter. Cotton exiting from the gin stands 24 passes through a conduit 104, through additional cleaning equipment (not shown) and then to a battery condenser 106 and to a baler 108. In other words, the seed cotton, downstream of the heater 62, is handled in a conventional manner. Air exiting from the battery condenser 106 may pass through a fan 110, merge with air from the inclined cleaner 22 and pass into the cyclone 26 where conveying air is separated from dust and trash to prevent a large dust cloud emitting from the gin 10.

It may be desirable to rehumidify cotton lint before or during baling because extremely dry cotton lint does not pack readily into bales which may be accomplished in any suitable manner.

It will be apparent that the wave energy heater may be incorporated into one or more of the ducts 38, preferably upstream of the first separator 20. As suggested previously, it is desirable to use polygonal ducts, such as square or rectangular rather than circular, as a conduit for the heater.

In some embodiments, the wave energy heater may be located at other locations or in conjunction with other equipment in a conventional cotton gin.

Figure 6:
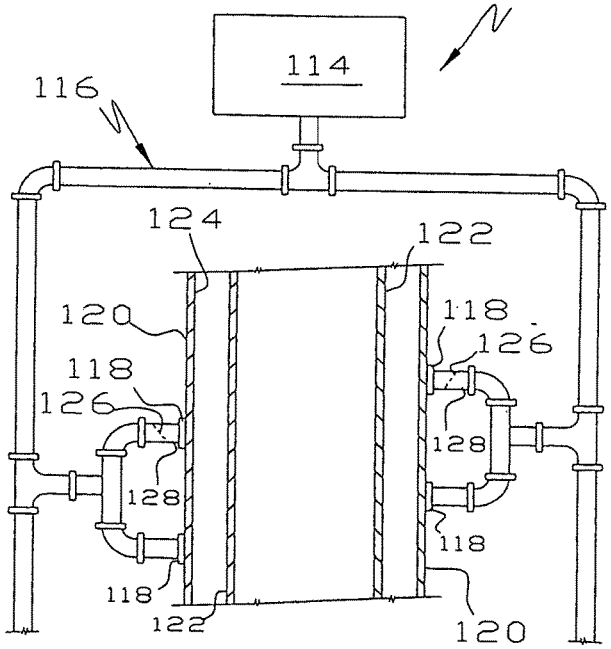
FIG. 6 is an enlarged view of another embodiment of a heating chamber illustrating the use of a single source of wave energy.
Figure 5:
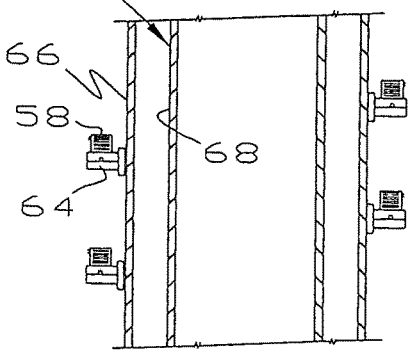
FIG. 5 is a partial enlarged cross-sectional view of a section of a conduit through which the heated material flows.

Referring to FIG. 6, there is illustrated another embodiment of a dryer/heater 112 having only one or a few wave generators 114 delivering wave energy through a more-or-less elaborate tubular wave guide 116 to a multiplicity of staggered locations 118 on a wall 120 offset from a feed control conduit 122 to provide a gap 124 between the wall 120 and the conduit 122. Any suitable means, such as a conventional microwave choke or a motor operated valve 126, may be provided to obstruct sections 128 of the wave guide 116 to stop or interrupt delivery of wave energy to selected parts of the feed control conduit 122. It will accordingly be seen that only one or a few wave generators 114 may be used in lieu of the large number of generators in the embodiment of FIGS. 2-5.

Figure 7:
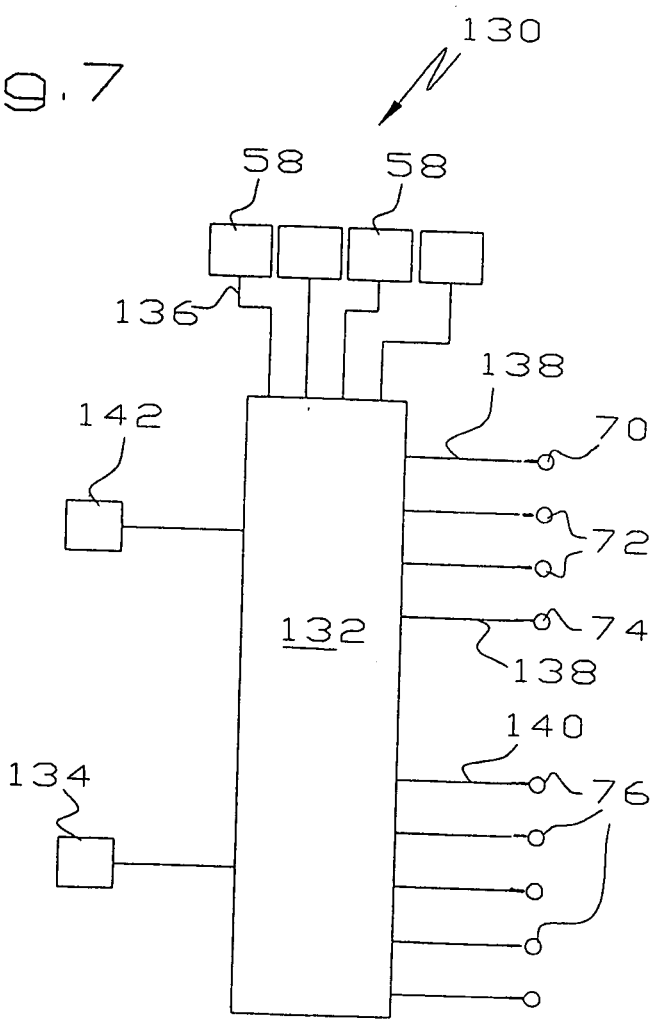
FIG. 7 is a schematic view of a control circuit used to deliver power to the wave energy generators.

Referring to FIG. 7, there is illustrated a schematic control circuit 130 for controlling the wave generators 58, the feed rollers 38 and wad buster 40 in response to inputs from the level sensors 70, 72, 74, the temperature sensors 76 and the humidity or moisture sensors 84, 102. A controller 132 acts as a switch to connect and disconnect the generators 58 to a power source 134. The controller 132 which may be a computer or other similar device may preferably be connected to each row of generators 58 through suitable wiring 136 to energize or simultaneously pulse all of the generators in a single row. The controller 132 connects to the level sensors 70, 72, 74 by a suitable communication link 138 as well as to each of the temperature sensors 76 by a suitable communication link 140. When the sensors 70, 72, 74, 84 indicate that operation of the feed controller 12 should commence, power is delivered to a suitable motor or motors 142 driving the feed rollers 38 and/or wad buster 40.

Operation of the circuit 130 will now be described. At start up or upon a restart, the lowermost level sensor 74 has to signal seed cotton in the conduit 46 before anything happens. Upon a signal from the sensor 74 and any sensors 70, 72 above it, the generators 58 are turned on below any sensor showing seed cotton. After the generators 58 have run for a while, and the lowermost temperature sensor 76 reaches a predetermined temperature suggesting that much of the liquid water adjacent the lowermost sensor 76 has vaporized, the motor 142 is powered to drive the feed rollers 38 and wad buster 40 to deliver seed cotton clumps toward the gin stands 24.

After a period of operation of the feed controller 18, the amount of energy delivered to the generators 58 may be controlled by a combination of a reading of the inlet moisture sensor 84, the outlet moisture sensor 102 and the temperature probes 76. If the outlet moisture sensor 102 is reading too high, power delivered to the generators 58 may be increased. If the outlet moisture sensor 102 is reading too low, power delivered to the generators 58 may be decreased. If the inlet moisture sensor 84 indicates an increase in incoming moisture, power delivered to the generators 58 may be increased. If the inlet moisture sensor 84 indicates a decrease in incoming moisture, power delivered to the generators 58 may be decreased. If the temperature sensors 76 indicate that temperatures in the conduit 46 are approaching a fire hazard value, power to the generators 58 may be reduced. It is believed the temperature readings of the sensors 76, in combination with the inlet moisture sensing, residence time in the conduit 46 and a desired outlet moisture sensing, during steady state operation is a proxy for liquid moisture content remaining on the seed cotton and thus is a candidate to control operation of the generators 58.

Figure 8:
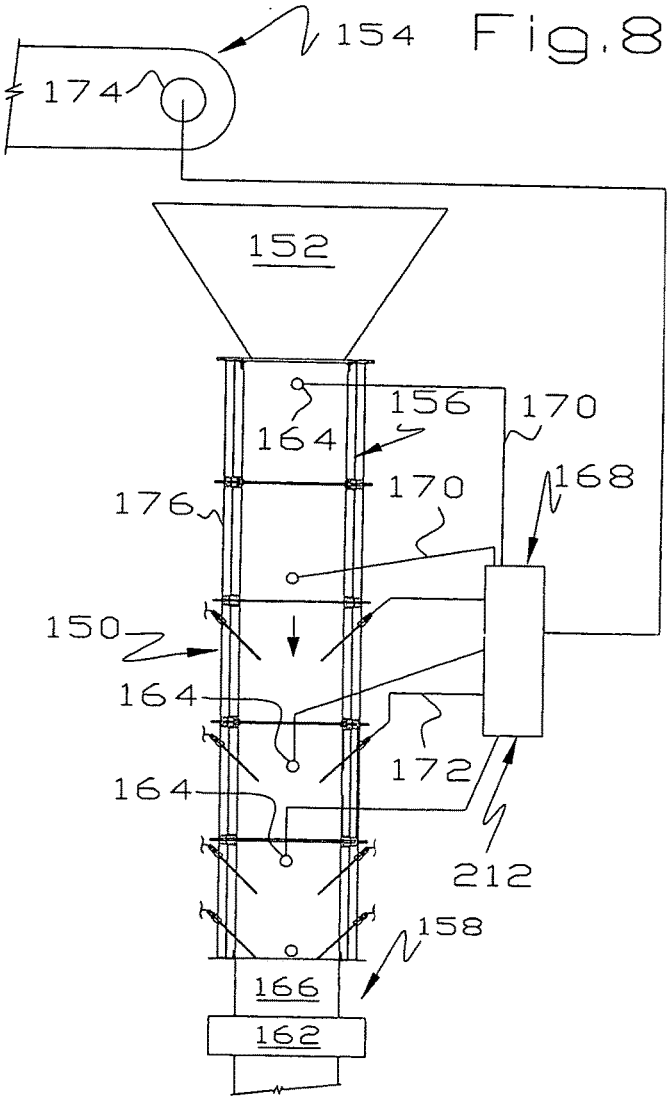
FIG. 8 is a view similar to FIG. 2 showing a dryer-heater suitable for use in an environment other than a cotton gin.

Referring to FIG. 8, there is illustrated a dryer/heater 150 adapted for user for drying nuts, seeds, grains and the like and which is very similar to the dryer/heater 18 except that it is free standing or part of a facility to handle commodities other than seed cotton, e.g. nuts, seeds, grains and the like. The dryer 150 can include a hopper 152 which can be loaded by a front end loader (not shown), a grain auger (not shown), a powered conveyor 154 or the like. The dryer 150 may also include a conduit 156 through which the treated material flows and an outlet structure 158 for controlling the rate of discharge from the conduit 156 and thus control the residence time in the conduit 156. The outlet structure 158 may include a conduit 160 and a feed controller 162 such as a motor operated valve, feed rollers and the like.

The dryer 150 can include level sensors 164, temperature probes 166 and a control circuit 168 connected to the sensors 164 and temperature probes 166 through communication links 170, 172 in much the same manner as the control circuit 130 is configured. The control circuit 168 detects various parameters from the sensors 164, 166 and energizes the outlet structure 162 and a motor 174 on the conveyor 154 to control flow through the conduit 156. The dryer 150 may include an outer wall 176 providing a gap between the wave energy generators (not shown) and the conduit 156 in the same manner as FIG. 5 or 6.

Figure 9:
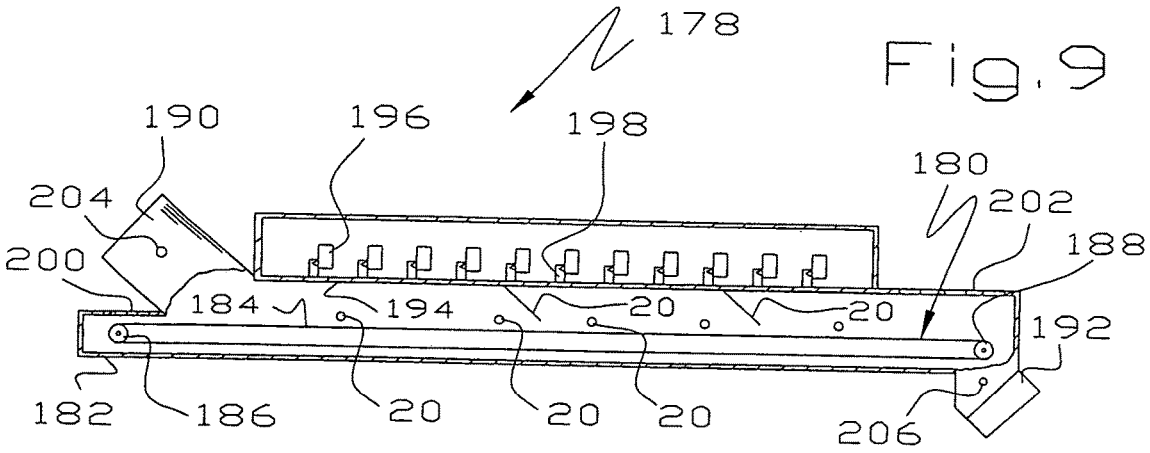
FIG. 9 is another embodiment of a dryer heater incorporating a belt conveyor and suitable for use in an environment other than a cotton gin.

Referring to FIG. 9, there is illustrated a dryer/heater 178 adapted for user for drying nuts, seeds, grains and the like that may be free standing or part of a facility to handle commodities other than seed cotton, e.g. nuts, seeds, grains and the like. A conventional belt or chain conveyor 180 is illustrated as a free standing device and includes a housing 182 which may be enclosed or open. Inside the housing 182 may be a belt or chain 184 is driven around a pair of pulleys 186, 188. At an inlet 190 of the conveyor 180, material to be treated is conveyed onto the belt or chain 184 and the material is discharged at an outlet 192. The belt or chain conveyor 180 will be recognized by those skilled in the art as conventional.

In some embodiments, the housing 182 conveniently includes a relatively flat upper wall 194 to which is mounted a series of wave generators 196, such as microwave generators, mounted on wave guides 198. The capacity and dispersion of the wave generators 196 is essentially the same as with the wave generators 58. The belt conveyor 180 may be used to transport nuts, seeds or grain in a conventional manner in a conventional location in a facility for handling such materials while the wave generators 196 convert the conveyor 180 into a combined conveyor and heater. In a typical application employing a relatively closed housing, the housing 182 may include an upstream perforated wall section 200 and a downstream perforated wall section 202 allowing the passage of air through the housing 182 thereby allowing the entry of relatively low humidity air through the inlet section 200 and the exit of high humidity air through the outlet section 202.

The heater 178 may be equipped with an upstream moisture sensor 204, a downstream moisture sensor 206, suitable sensors 208 detecting material on the belt or chain 184 and suitable temperature sensors 210 which act as inputs to a control circuit (not shown) analogous to the control circuits 130, 168 to control the flow of material through the heater 178 and control the moisture content of material exiting from the heater 178.

The circulation of air through the housing 182 may not be feasible with seed cotton because of the plugging of the outlet section by cotton lint but, otherwise, the addition of suitable air locks (not shown) on the inlet and outlet ends of the heater 178, it may be converted to heat or dry pneumatically conveyed seed cotton.

Although this invention has been disclosed and described in its preferred forms with a certain degree of particularity, it is understood that the present disclosure of the preferred forms is only by way of example and that numerous changes in the details of operation and in the combination and arrangement of parts may be resorted to without departing from the spirit and scope of the invention as hereinafter claimed.

I claim:

1. A cotton gin comprising, in series, a module feeder, a dryer, at least one gin stand and a bale press, the dryer comprising a vertical conduit passing seed cotton downwardly, a series of vertically spaced wave generators to deliver wave energy into the conduit and heat the seed cotton thereby evaporating water therefrom, and means for detecting a level of seed cotton in the conduit at least at three vertically spaced locations; and a control unit connected to the level detecting means and to the wave energy generators to deliver energy only to those wave energy generators below the detected level of seed cotton in the conduit.

2. The cotton gin of claim 1 further comprising a series of vertically spaced thermal sensors inside the conduit to determine temperatures at various levels inside the conduit, the thermal sensors being connected to the control unit, the control unit delivering energy to the wave generators in response to the level detecting means and to the thermal sensors.

3. The cotton gin of claim 2 wherein the thermal sensors comprise an elongate element defining an acute angle with a vertical axis of movement of seed cotton.

4. The cotton gin of claim 2 wherein the control unit comprises means detecting a region of high temperature in the vertical conduit and delivering energy to the wave generators downstream of the region of high temperature.

5. The cotton gin of claim 1 wherein the conduit includes an outer wall and an inner wall, the inner wall defining a flow area through the conduit, the wave generators being mounted on the outer wall and being spaced from the inner wall by a gap between the inner and outer walls.

6. The cotton gin of claim 5 wherein the outer conduit wall provides a first conduit and the inner wall provides a second conduit inside the first conduit.

7. A dryer for agricultural products, comprising a vertical conduit passing an agricultural product downwardly, a series of vertically spaced wave generators to deliver wave energy into the conduit and heat the agricultural product thereby evaporating water therefrom, and means for detecting a level of agricultural product in the conduit at least at three vertically spaced locations; and a control unit connected to the level detecting means and to the wave energy generators to deliver energy only to those wave energy generators below the level of agricultural product in the conduit.

8. The dryer of claim 7 further comprising a series of vertically spaced thermal sensors inside the conduit to determine temperatures at various levels inside the conduit, the thermal sensors being connected to the control unit, the control unit delivering energy to the wave generators in response to the level detecting means and to the thermal sensors.

9. The dryer of claim 8 wherein the thermal sensors comprise an elongate element defining an acute angle with a vertical axis of movement of agricultural product.

10. The dryer of claim 8 wherein the control unit comprises means detecting a region of high temperature in the vertical conduit and delivering energy to the wave generators downstream of the region of high temperature.

11. The dryer of claim 7 wherein the conduit includes an outer wall and an inner wall, the inner wall defining a flow area through the conduit, the wave generators being mounted on the outer wall and being spaced from the inner wall by a gap between the inner and outer walls.

12. The dryer of claim 11 wherein the outer conduit wall provides a first conduit and the inner wall provides a second conduit inside the first conduit.

13. A cotton gin comprising, in series, a module feeder, a dryer, at least one gin stand and a bale press, the dryer comprising a vertical conduit passing seed cotton downwardly, a series of vertically spaced wave generators to deliver wave energy into the conduit and heat the seed cotton thereby evaporating water therefrom, means for detecting a level of seed cotton in the conduit at least at three different vertically spaced locations and a series of vertically spaced thermal sensors to detect a series of vertically spaced temperatures in the conduit; and a control unit connected to the level detecting means and to the wave energy generators and means responsive to the level detecting means and to the thermal sensors for energizing less than all of the wave generators.

14. The cotton gin of claim 13 wherein the thermal sensors each comprise an elongate element defining an acute angle with a vertical axis of movement of seed cotton.

15. The cotton gin of claim 13 wherein the control unit delivers energy only to those wave energy generators below the level of seed cotton in the conduit.

16. The cotton gin of claim 13 wherein the control unit comprises means detecting a region of high temperature in the vertical conduit and delivering energy to the wave generators downstream of the region of high temperature.

17. The cotton gin of claim 1 wherein the level detecting means comprises a series of sensors comprising an upper sensor, a lower sensor and at least one intermediate sensor.

18. The dryer of claim 7 wherein the level detecting means comprises a series of sensors comprising an upper sensor, a lower sensor and at least one intermediate sensor.

19. The cotton gin of claim 13 wherein the level detecting means comprises a series of sensors comprising an upper sensor, a lower sensor and at least one intermediate sensor.

* * * * *